US008586883B2

(12) United States Patent
Hsu

(10) Patent No.: US 8,586,883 B2
(45) Date of Patent: Nov. 19, 2013

(54) KEY MODULE FOR PORTABLE DEVICES

(75) Inventor: Wei Hsu, New Taipei (TW)

(73) Assignee: Weistech Technology Co., Ltd., New Taipei (TW)

( * ) Notice: Subject to any disclaimer, the term of this patent is extended or adjusted under 35 U.S.C. 154(b) by 255 days.

(21) Appl. No.: 13/157,301

(22) Filed: Jun. 9, 2011

(65) Prior Publication Data

US 2011/0240453 A1 Oct. 6, 2011

(30) Foreign Application Priority Data

Mar. 8, 2010 (TW) ..... 100204099 U

(51) Int. Cl.
*H01H 13/76* (2006.01)

(52) U.S. Cl.
USPC ..... 200/5 A

(58) Field of Classification Search
USPC ..... 200/4, 5 A, 5 R, 6 R, 238, 244, 262–270, 200/314, 317
See application file for complete search history.

(56) References Cited

U.S. PATENT DOCUMENTS 4,408,103 A * 10/1983 Smith, III ..... 200/6 A
4,536,625 A * 8/1985 Bebie ..... 200/5 A
4,539,444 A * 9/1985 Senoh ..... 200/5 R
4,568,918 A * 2/1986 Edel ..... 341/24
4,609,791 A * 9/1986 Abbat ..... 200/5 A
4,687,200 A * 8/1987 Shirai ..... 463/37
4,734,679 A * 3/1988 Haskins ..... 341/22
4,739,127 A * 4/1988 Higuchi et al. ..... 200/5 R
4,892,988 A * 1/1990 Ishii ..... 200/516
4,896,003 A * 1/1990 Hsieh ..... 200/6 A
5,396,030 A * 3/1995 Matsumiya et al. ..... 200/6 A
5,403,984 A * 4/1995 Ogawa ..... 200/517
5,426,275 A * 6/1995 Maeda et al. ..... 200/553
5,498,843 A * 3/1996 Date et al. ..... 200/6 A
5,508,479 A * 4/1996 Schooley ..... 200/5 R
5,525,770 A * 6/1996 Matsumiya et al. ..... 200/6 A
5,603,400 A * 2/1997 Goto et al. ..... 200/302.3
5,714,732 A * 2/1998 Lee ..... 200/6 R
5,847,336 A * 12/1998 Thornton ..... 200/5 A
5,889,242 A * 3/1999 Ishihara et al. ..... 200/6 A
RE36,349 E * 10/1999 Matsumiya et al. ..... 200/6 A
RE36,738 E * 6/2000 Matsumiya et al. ..... 200/6 A
6,162,999 A * 12/2000 Ishikawa et al. ..... 200/6 A
6,329,614 B1 * 12/2001 Miyashita ..... 200/5 R
6,545,239 B2 * 4/2003 Pedersen et al. ..... 200/553
7,009,127 B2 * 3/2006 Hoelzle et al. ..... 200/315
7,786,394 B2 * 8/2010 Gao et al. ..... 200/314

(Continued)

*Primary Examiner* — Briggitte R Hammond

(57) ABSTRACT

A key module for portable devices includes a PCB having at least one pair of high resistance film and welding point, a rubber key having a protruded key head, and a set of upper case and bottom case. The rubber key has two conducting carbon arcs opposite to the at least one pair of high resistance film on a concave backside thereof. A top of the head portion has a concave on a middle portion thereof and two protrusions on right and left ends thereof for specific input functions. The upper case has at least one through hole for revealing the concave and the protrusions of the head portion while the rubber key and the PCB are covered by the upper and bottom cases.

8 Claims, 8 Drawing Sheets

(56) References Cited

U.S. PATENT DOCUMENTS

| | | | | |
|---|---|---|---|---|
| 7,952,038 | B1 * | 5/2011 | Ando et al. | 200/1 B |
| 7,965,204 | B2 * | 6/2011 | Bredow et al. | 341/20 |
| 8,153,915 | B2 * | 4/2012 | Eckert | 200/6 A |
| 2001/0042681 | A1 * | 11/2001 | Yoon et al. | 200/517 |
| 2004/0129542 | A1 * | 7/2004 | Kawaguchi et al. | 200/61.1 |
| 2004/0140183 | A1 * | 7/2004 | Yen | 200/5 A |
| 2005/0066370 | A1 * | 3/2005 | Alvarado et al. | 725/80 |
| 2006/0131156 | A1 * | 6/2006 | Voelckers | 200/512 |
| 2007/0144873 | A1 * | 6/2007 | Chen | 200/5 A |
| 2010/0126838 | A1 * | 5/2010 | Lee | 200/339 |
| 2010/0320068 | A1 * | 12/2010 | Tsai | 200/5 A |

* cited by examiner

KEY MODULE FOR PORTABLE DEVICES

FIELD OF THE INVENTION

The present invention relates to key modules, and particular to a key module having at least three different operations of each key. Each operation of the key only requires a single press to achieve so that the number, manufacture cost, operating time, and miss input can be reduced.

DESCRIPTION OF THE PRIOR ART

Accordingly, common portable devices can be briefly divided into two types which are one with a display and one without the display.

For the portable devices without a display such as home universal remote control, game console controller, or remote control of TV and DVD player, they need as much number of key as the functions they could provide. The keys are made up of low resistance film for sensitively operating. However, electronic devices are made smaller and smaller so that the keys are also shrunken and arranged closely which are hard to recognize and operate. Such prior portable device don't have input function in characters, numbers, and symbols and have disadvantages of too many parts, high manufacture cost, hard to use and find the function needed, too sensitive for unintentionally input.

Moreover, for the portable devices having a display such as cell phone, PDA (Personal Digital Assistant), electric dictionary, MP3 player (MPEG Audio Player 3), or a laptop, they already have keys for characters, numbers, and symbols input. Each key has at least one function so that a cycling input is needed. For example, a key has three functions of root 「ㄅ」,「ㄆ」,「ㄇ」 so that a user should give one press for the 「ㄅ」, two for the 「ㄆ」, and three for the 「ㄇ」. User must keep pressing the same key and be cautioned not too much until the needed shows up. Obviously, such method is time consuming.

It is certainly that more function will be combined to portable devices in the future, and display can be a common feature in many portable devices. The present invention is capable of provide solution for above disadvantages.

SUMMARY OF THE PRESENT INVENTION

Accordingly, the primary object of the present invention is to provide a key module which each key has at least three operations so as to reduce the number of key, time for operating, manufacture cost, and wrong input. It also provides a capability of input in characters, numbers, and symbols.

A secondary object of the present invention is to provide a key module suitable for portable devices equipped with a display such as cell phone, PDA (Personal Digital Assistant), electric dictionary, MP3 player (MEPG Audio Player 3), or a laptop.

A yet object of the present invention is to provide a key module suitable for portable device without a display such as home universal remote control, TV remote control, DVD player remote control, game console controller, or air conditioner remote control.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
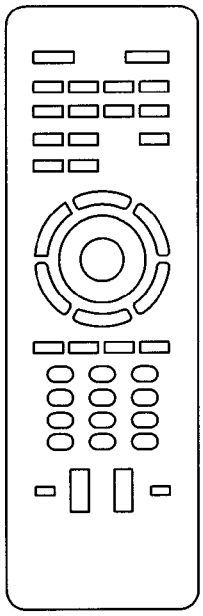
FIG. 1 is a schematic view showing a prior portable device.
Figure 2:
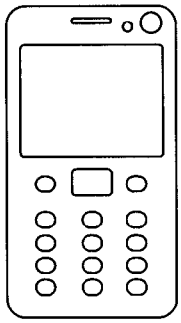
FIG. 2 is a schematic view showing another portable device.
Figure 3:
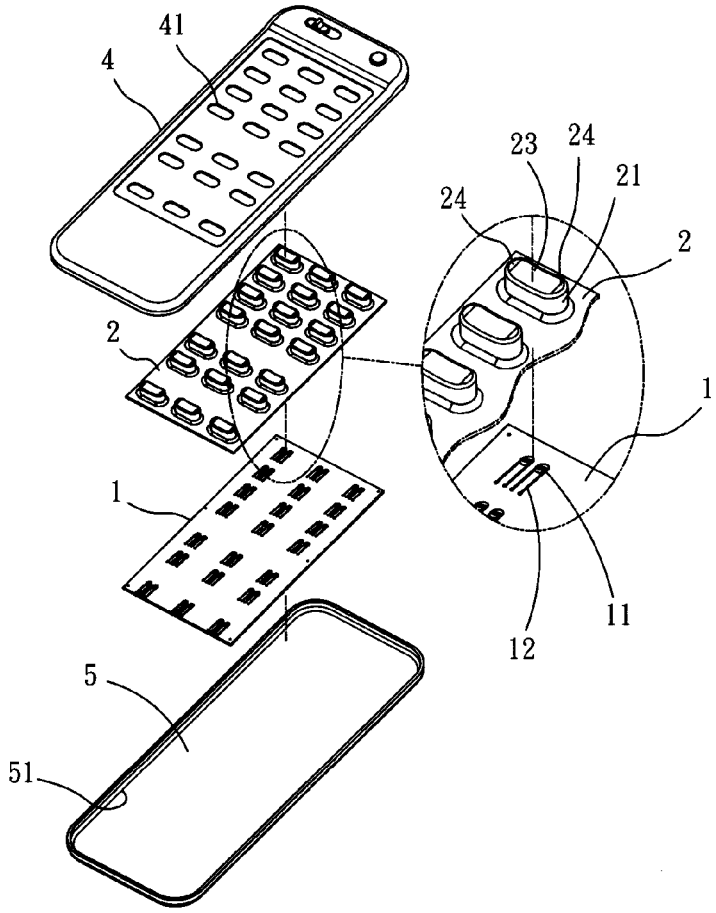
FIG. 3 is an exploded view showing a preferable embodiment of the present invention.
Figure 4:
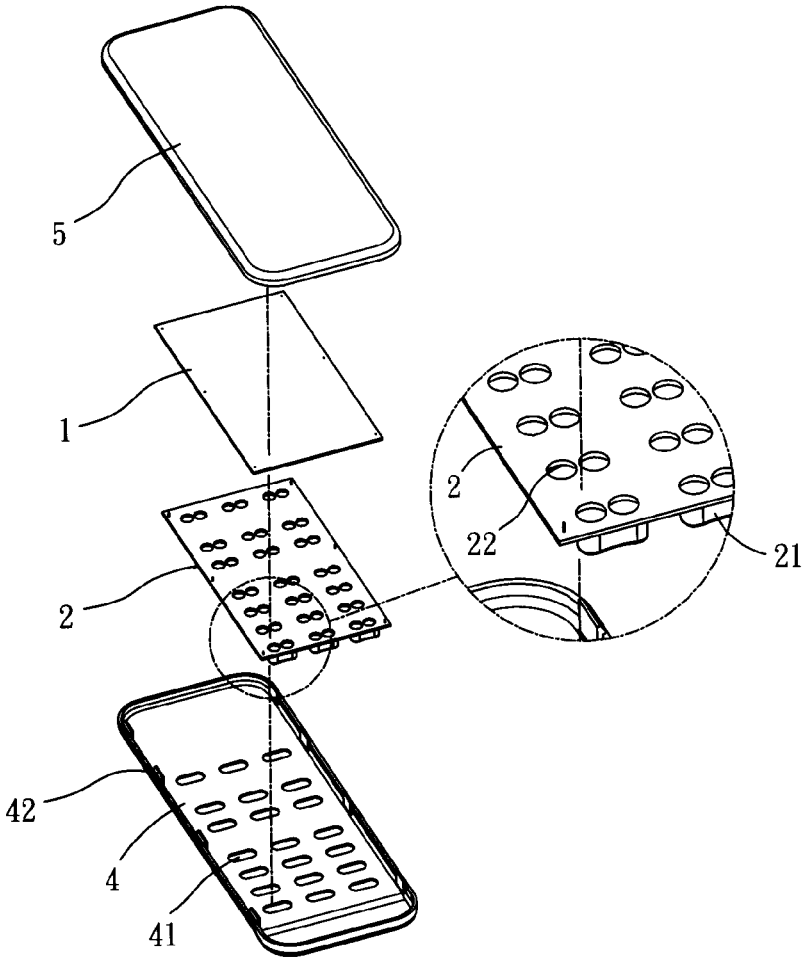
FIG. 4 is another exploded view showing the preferable embodiment of the present invention.

A preferable embodiment of a key module for portable devices of the present invention applied to a universal remote control is illustrated in FIGS. 3 and 4. The universal remote control consists of a printed circuit board 1, a key pad having a plurality of rubber key 2, and a set of upper case 4 and bottom case 5.

The printed circuit board 1 has at least one pair of high resistance film 11 with welding point 12.

A protruded head portion 21 is formed to a side of the rubber key 2, two conducting carbon arcs 22 are formed on a concave backside of the head portion 21. The conducting carbon arcs 22 are arranged opposite to the high resistance films 11. A concave 23 is formed to a middle of the head portion 21 so that two protrusions 24 are formed on both two sides of the concave 23 so that the rubber key 2 can be pressed in different patterns for specific functions.

The upper case 4 and bottom case 5 can be assembled together with the printed circuit board 1 and the rubber key 2 arranged between. A through hole 41 is formed to the upper case 4 so that the head portion 21 will completely fit in the through hole 41 with the concave 23 and two protrusions 24 protruding from the through hole 41. A plurality of tenon 42 is formed to an inner side of the upper case 4, and a corresponding slot 51 is formed to an inner side of the bottom case 5. The upper case 4 and the bottom case 5 can be tightly combined by connection between the tenon 42 and the slot 51. However, the assembling is not to confirm the scope of the invention. Other assembling method through buckling or bolt can achieve the same effect.

Figure 5:
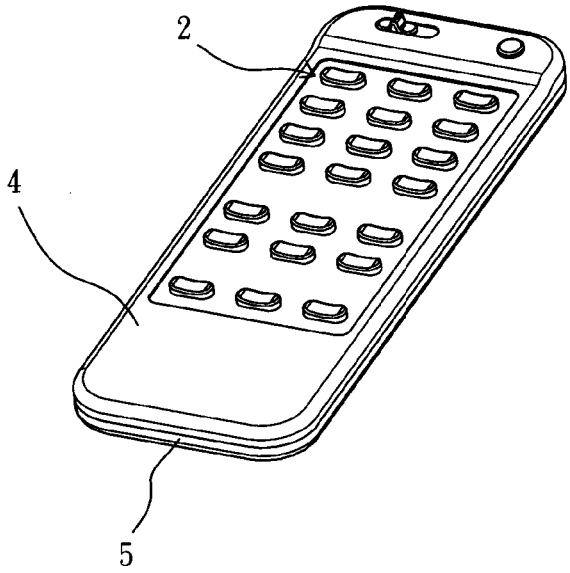
FIG. 5 is a schematic view showing the portable device of the preferable embodiment of the present invention.

Referring to FIG. 5, a schematic view of the assembling of the universal remote control is shown. The rubber key 2 and the printed circuit board 1 are arranged in order between the upper case 4 and the bottom case 5. Through the connection of the tenons 41 and slot 42, the universal remote control is formed and each rubber key 2 has at least three operations.

Figure 6:
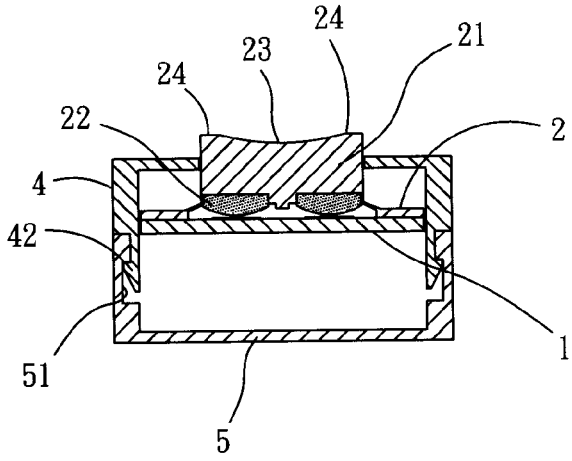
FIG. 6 is a cross-section view showing a key module of the preferable embodiment.

Referring to FIG. 6, a cross-section view of the key module of the preferable embodiment is shown. The two conducting carbon arcs 22 are arranged above the two high resistance films 11 individually so that the head portion 21 can be operated in different modes. While there is no press being applied to the head portion 21, the conducting carbon arcs 22 were suspended above the high resistance films 11. The remote control will stay standby for there is no contact between the conducting carbon arcs 22 and the high resistance films 11.

Figure 7:
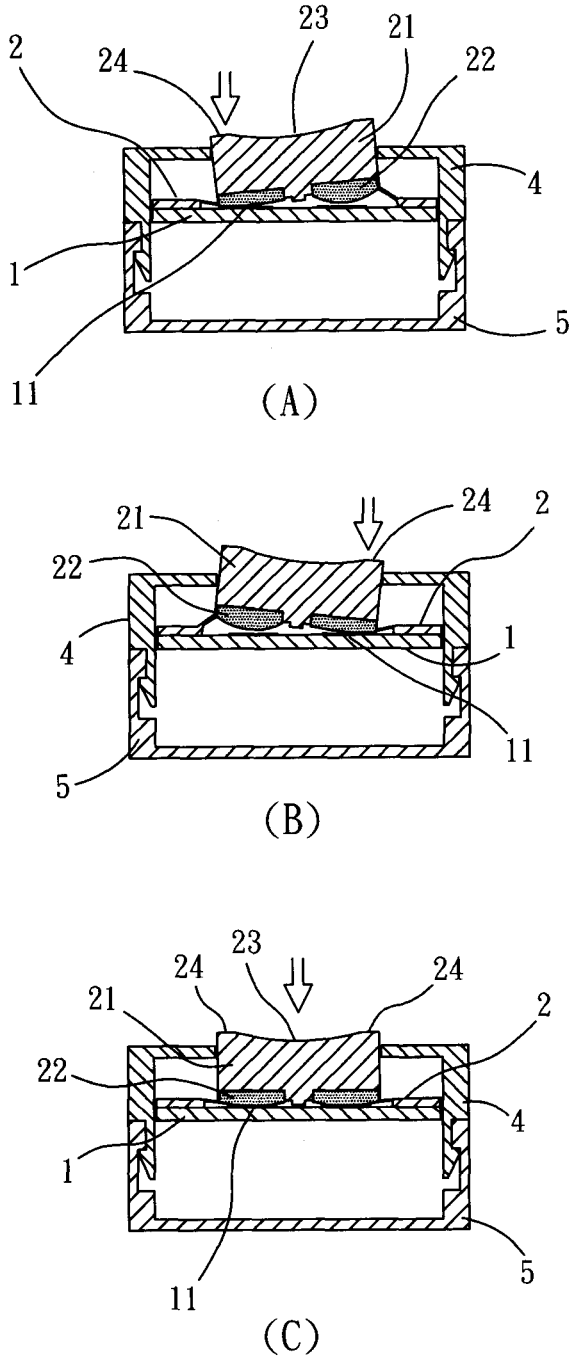
FIG. 7(A) is a cross-section view showing an operation of the key module of the present invention.
FIG. 7(B) is a cross-section view showing another operation of the key module of the present invention.
FIG. 7(C) is a cross-section view showing one another operation of the key module of the present invention.

The operations of the head portion 21 are shown in FIGS. 7(A), 7(B), and 7(C). While a force is applied to the left protrusion 24 illustrated in FIG. 7(A), the conducting carbon arc 22 below the pressed protrusion 24 will contact the corresponding high resistance film 11 below. In the same way, the right conducting carbon arc 22 will contact the corresponding high resistance film 11 while a force is applied to the right protrusion 24 illustrated in FIG. 7(B). Moreover, both conducting carbon arcs 22 will contact both the high resistance films 11 while a force is applied to the concave 23.

Figure 8:
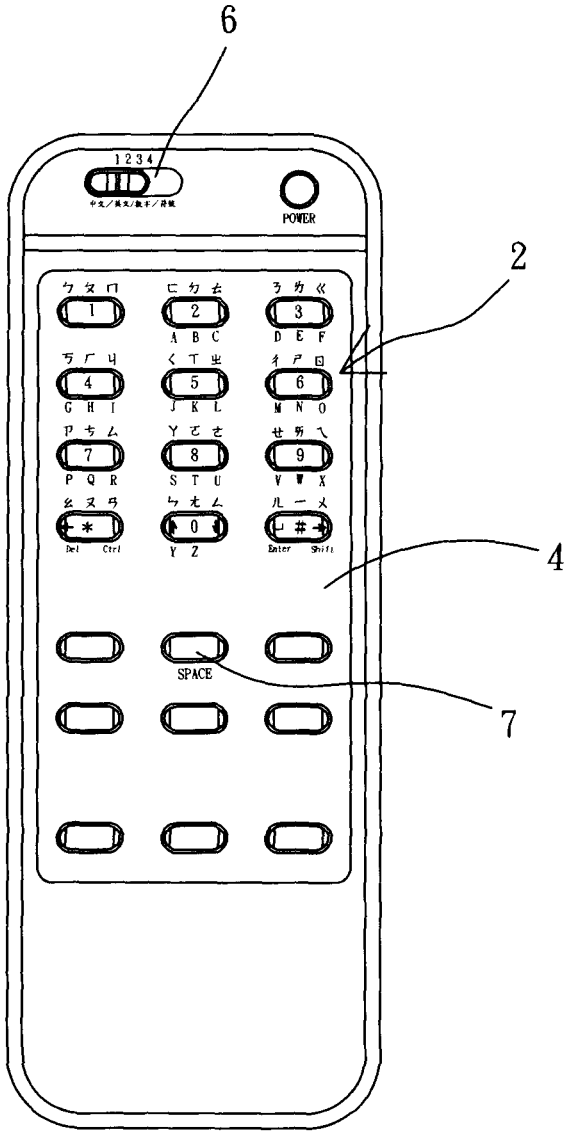
FIG. 8 is a schematic view showing a application of the key module of the preferable embodiment of the present invention.

The above key module can be applied to portable devices without a display such as home universal remote control, TV remote control, DVD player remote control, game console controller, or air conditioner remote control. It can be also applied to portable device having a display such as cell phone, PDA (Personal Digital Assistant), electric dictionary, MP3 player (MEPG Audio Player 3), or a laptop. A universal remote control having the key module of the present invention is illustrated in FIG. 8. The universal remote control has a switch 6 serving to switch input mode between Chinese, English, and number by pressing or stirring. The universal remote control also has a SPACE key and a plurality of key module arranged in order. Each key module has three operation modes so that each key module can input three different root, alphabet, number, or symbol. A key module can take the place of three conventional keys. The difference of the key module of the present invention is that only one press is needed for any root, alphabet, number, or symbol. For example, to input a Chinese phrase「朋友」, the「朋」can be texted by pressing the concave 31 of the key on the first column from left and first row from the up and following by pressing the right protrusion 32 of the key on the second column and fourth row, and ending with a SPACE. The「友」can be texted by pressing the concave 31 of the key on the third column for left and the fourth row from up and following by pressing the concave 31 of the key on the first column and the fourth row, and ending with a SPACE. The time for texting can be efficiently shortened because any root, alphabet, number, or symbol can be texted by a single press. Because of the high resistance film 11 and the conducting carbon arc 22, a miss input can be certainly lowered.

Figure 9:
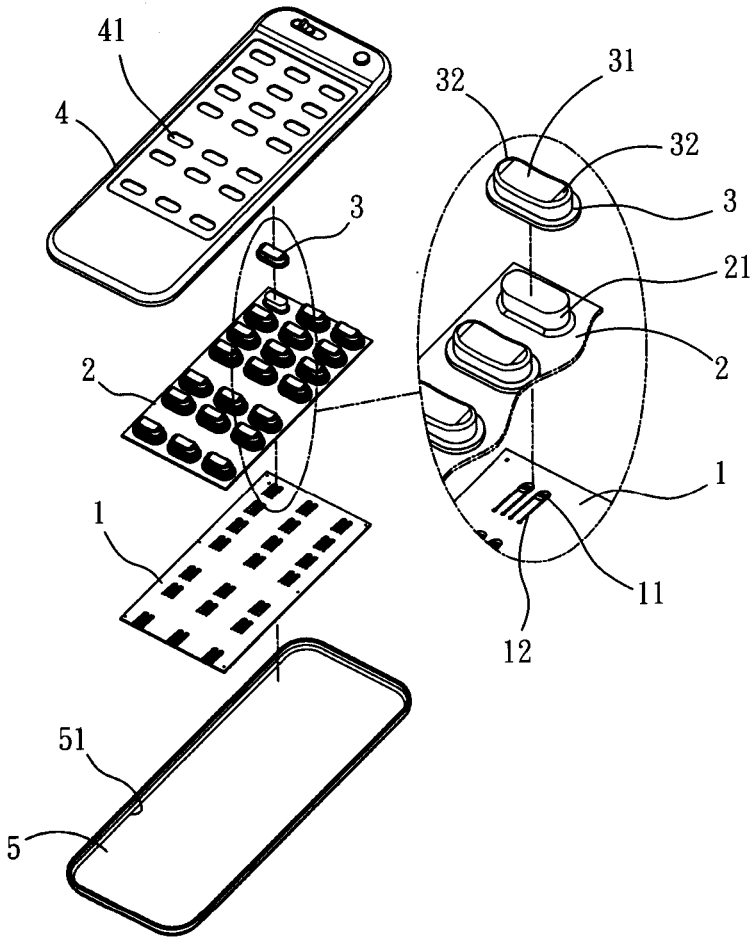
FIG. 9 is an exploded view showing the second preferable embodiment of the present invention.

Referring to FIG. 9, another preferable embodiment of the present invention applied to a universal remote control is illustrated. The universal remote control consists of a PCB1, a key pad having at least one rubber key 2, at least one key cap 3, and a set of upper case 4 and bottom case 5. The difference from previous preferable embodiment is that a head portion 21 of the at least one rubber key 2 is covered by a key cap 3. The key cap 3 serves to cover upon the head portion 21, and a top of the key cap 3 has a concave 31 on the middle and two protrusions 32 on both right and left ends so as to protect the head portion 21 from being damaged by repeatedly press and to prolong a lifetime. The upper case 4 and bottom case 5 are the same as the previous embodiment. A through hole 41 is formed to the upper case 4 so that the key cap 3 and the head portion 21 of the rubber key 2 will completely fit in the through hole 41 with the concave 31 and two protrusions 32 protruding from the through hole 41.

Figure 10:
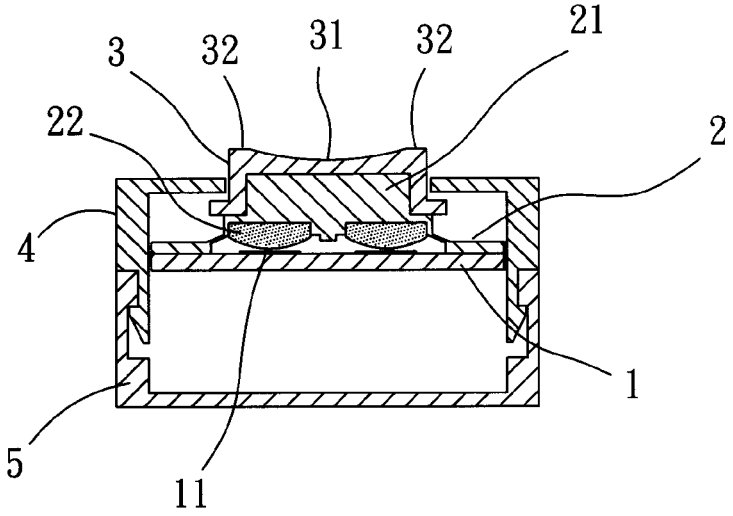
FIG. 10 is a cross-section view showing a key module of the second preferable embodiment.

Referring to FIG. 10, a cross-section view of the key module of the second preferable embodiment is shown. Two conducting carbon arcs 22 formed to the head portion 21 are arranged above two high resistance films 11 on the PCB 1 individually so that the key cap 3 can be operated in three different modes. While there is no press being applied to the key cap 3, the conducting carbon arcs 22 were suspended above the high resistance films 11. The remote control will stay standby for there is no contact between the conducting carbon arcs 22 and the high resistance films 11. User can press the key cap 3 on the left protrusion 32, right protrusion 33, or central concave 31 for specific function depending on the needs.

Therefore, the present invention can be perfectly applied to portable device without a display such as home universal remote control, game console controller, or remote control of TV, DVD player so as to provide additional input function of characters, numbers, or symbols. Also, for the portable device with a display such as cell phone, PDA (Personal Digital Assistant), electric dictionary, MP3 player (MEPG Audio Player 3), or laptop, the present invention can also reduce the number of key, time for texting, manufacture cost, and wrong input.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A key module for portable devices comprising:

a printed circuit board, having at least one pair of resistive film portions, and each of the resistive film portions being provided with a welding point; and a rubber key, having a protruding head portion on an end thereof and two conducting carbon arcs on a concave backside thereof; the two conducting carbon arcs being arranged opposite to the at least one pair of resistive film portions, and a top of the head portion of the rubber key having a concave portion and two protrusions being formed on both sides of the concave portion.

2. The key module for portable devices as claimed in claim 1, wherein the key module has a key cap having a concave on a top with a protrusion on both sides of the concave, and the key cap being arranged upon the head portion of the rubber key.

3. The key module for portable devices as claimed in claim 1, wherein the key module includes a set of upper case and bottom case: the upper case has at least one through hole.

4. The key module for portable devices as claimed in claim 3, wherein the upper case and the bottom case is connected together through tenon and corresponding slot.

5. The key module for portable devices as claimed in claim 3, wherein the upper case and the bottom case is connected together through bolt or buckling.

6. The key module for portable devices as claimed in claim 3, wherein a plurality of key module and the upper, bottom case are combined as a universal remote control.

7. The key module for portable devices as claimed in claim 3, wherein a plurality of key module is applied to portable device without a display.

8. The key module for portable devices as claimed in claim 3, wherein a plurality of key module is applied to portable devices with a display.

* * * * *